US006840482B2

(12) United States Patent
Downey et al.

(10) Patent No.: US 6,840,482 B2
(45) Date of Patent: Jan. 11, 2005

(54) MOUNTING BRACKET FOR CURTAIN RODS

(76) Inventors: Joanne Downey, 11 Liberty Ave., Linden, NJ (US) 07036; Tim McMenamin, Sr., 222 Madison St., Linden, NJ (US) 07036

( * ) Notice: Subject to any disclaimer, the term of this patent is extended or adjusted under 35 U.S.C. 154(b) by 0 days.

(21) Appl. No.: 09/845,230

(22) Filed: May 1, 2001

(65) Prior Publication Data

US 2002/0162929 A1 Nov. 7, 2002

(51) Int. Cl.[7] ..... A47H 1/10

(52) U.S. Cl. ..... 248/26; 248/263

(58) Field of Search ..... 248/262, 261, 248/263, 255; 160/89

(56) References Cited

U.S. PATENT DOCUMENTS 1,786,038 A * 12/1930 Swanson ..... 248/307

* cited by examiner

*Primary Examiner*—Ramon O Ramirez
(74) *Attorney, Agent, or Firm*—Ezra Sutton

(57) ABSTRACT

Curtain mounting brackets for curtain rods for use with conventional blind bracket mounting devices of a blind assembly for attaching one or more curtain rods thereon in order to hold a curtain and/or valance thereto. The curtain mounting brackets include a first bracket housing having a first holding wall member with an upper channel, a lower channel, a first side perimeter edge and a second side perimeter edge; the first holding wall member having mounted thereon a first curtain rod holding prong member and a second curtain rod holding prong member; and the upper and lower channels of the first holding wall member are for engaging and being joined to an upper and lower receiving channel of the conventional blind bracket mounting device, respectively for preventing one end of the blind assembly from falling out of the blind bracket mounting device. The curtain mounting brackets also include a second bracket housing having a second holding wall member with an upper channel, a lower channel, a third side perimeter edge and a fourth side perimeter edge; the second holding wall member having mounted thereon a third curtain rod holding prong member and a fourth curtain rod holding prong member; and the upper and lower channels of the second holding wall member are for engaging and being joined to an upper and lower receiving channel of the conventional blind bracket mounting device, respectively, for preventing the other end of the blind assembly from falling out of the blind bracket mounting device. The curtain rod holding prong members of the first and second holding wall members are used for receiving one or more curtain rods thereon.

30 Claims, 6 Drawing Sheets

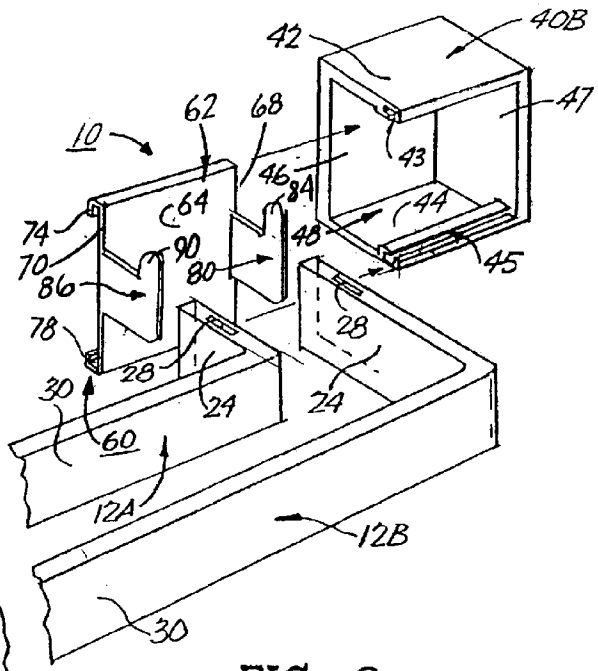
FIG. 3
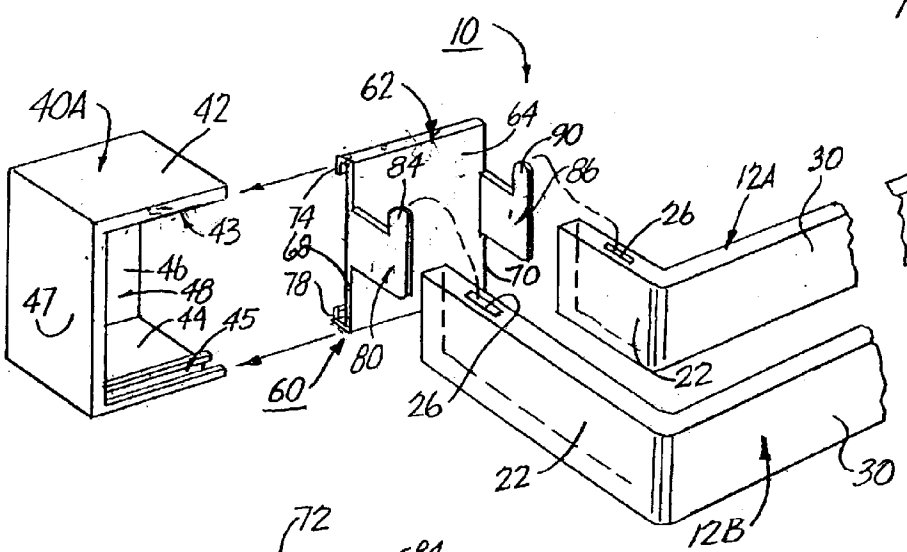
FIG. 4
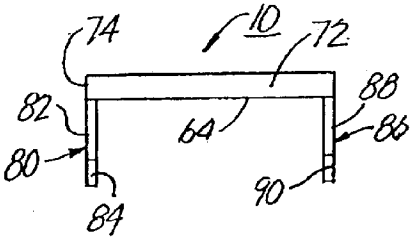
FIG. 5
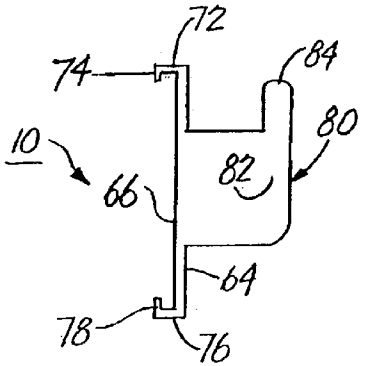

MOUNTING BRACKET FOR CURTAIN RODS

FIELD OF THE INVENTION

The invention relates to a mounting bracket for use in attaching curtain rods in conjunction with a standard blind bracket mounting device of a blind assembly. More particularly, the mounting bracket is slidably mounted on the blind assembly and prevents the blind assembly form falling out of the blind bracket mounting device.

BACKGROUND OF THE INVENTION

Mounting brackets of various designs have been used to support shades, blinds, curtains, valances, cornices and the like. These brackets are mounted or fastened to a wall, or to a window frame or to a blind apparatus in a number of various positions depending upon the structure of the mounting bracket and/or hanging element (i.e. curtain). Conventional designs for these mounting brackets include channel-type, metal headrails; box-like metal structures having a plurality of slide plates therein; U-shaped metal structures having a screw clamp; an L-shaped metal flange having a snap holder; an inverted L-shaped metal stamping having horizontal and vertical wings; and an inverted L-shaped metal flange having a slide plate holder.

However, these prior art mounting brackets have various drawbacks and have not been completely satisfactory. For example, they do not securely hold the curtain or blinds to prevent them from being pulled out of the mounting bracket during use.

It would be highly desirable to provide curtain mounting brackets which are integrated with the blind apparatus, and easily mounted for simple installation. The curtain mounting brackets when installed should hold the curtain rod(s) firmly locked in place to avoid the curtain rod(s) being snapped out of the blind apparatus during the use of the blind or curtain members.

DESCRIPTION OF THE PRIOR ART

Mounting brackets for blinds and curtains or valances of various designs, configurations structures and materials of construction have been generally disclosed in the prior art. For example, U.S. Pat. Nos. 5,392,833 and 5,439,042 to OHANESIAN disclose a vertical blind assembly with curtain attachments. Mounting brackets are provided which connect a rear portion of the curtain to individual slat carriers slidably mounted within the housing of the vertical blind assembly. In this manner, lateral movement of the carriers, which causes opening and closing of the vertical blinds, likewise causes an opening and closing of the curtain. The bracket extends a sufficient distance from the housing such that the curtain does not hinder pivoting of the vertical blinds. These prior art patents do not disclose or teach the design, structure and configuration of the curtain mounting bracket of the present invention.

U.S. Pat. No. 5,529,273 to BENTHIN discloses mounting bracket devices for window and door coverings in which these devices are used for mounting curtain rods and blind tracks. The mounting bracket and base is secured to an arm by a fastener. A cam post has a head that is connected to the arm by a shaft. A spring clip has an aperture that is contoured in correspondence with the head and is retained between the head and arm at selected angular positions about the cam post. This prior art patent does not disclose or teach the design, structure and configuration of the curtain mounting bracket of the present invention.

U.S. Pat. No. 5,667,178 to YANG discloses a bracket assembly for mounting a shade. The mounting bracket assembly is provided for supporting shades, blinds, curtains, cornices, and valances having a support rail, which includes an L-shaped mounting section having an integrally connected back member, interior side members and an extended top member, and the extended top member having a U-shaped channel formed therein for fitting into a U-shaped channel of the support rail. It also includes an L-shaped holding section having an integrally connected rear member, exterior side members, and a bottom support member for supporting the support rail in place. A threaded bolt is provided for connecting an interior lip member of the mounting section with an exterior lip member of the holding section to join the mounting section and the holding section to form the mounting bracket assembly. This prior art patent does not disclose or teach the design, structure and configuration of the curtain mounting bracket of the present invention.

U.S. Pat. No. 5,979,848 to KURTHY et al discloses a curtain and mini blind hanger. The window covering hanger includes a mounting bracket having a horizontally oriented top face and a vertically oriented rear face coupled to a rear edge of the top face and depending downwardly therefrom. A front face is coupled to a front edge of the top face and depends downwardly therefrom. The top face of the mounting bracket rests on a top ledge of a window frame and the rear face is situated between the window frame and an adjacent wall. A securement machanism is mounted on the mounting bracket for securing to an end of a rod of a window covering. This prior art patent does not disclose or teach the design, structure and configuration of the curtain mounting bracket of the present invention.

None of the aforementioned prior art patents teach or disclose the features and structure of a curtain mounting bracket for use with standard blind tracs, such that the mounting bracket is integrated with a standard blind apparatus in order to hold two standard curtain flat rods or a standard cylindrical curtain rod(s) in place.

Accordingly, it is an object of the present invention to provide a curtain mounting bracket for use in attaching one or more curtain rods for hanging curtains and valances in conjunction with a blind bracket mounting device of a standard blind apparatus.

Another object of the present invention is to provide a curtain mounting bracket that is an integrated component of the blind bracket mounting device and prevents the vertical or horizontal blind members from falling out.

Another object of the present invention is to a curtain mounting bracket that does not utilize any screws, staples or nails, nor do damage to a window border.

Another object of the present invention is to provide a curtain mounting bracket that does not require any permanent setting on the blind frame assembly, and each curtain mounting bracket is slidably mounted within each blind bracket mounting device.

Another object of the present invention is to provide a curtain mounting bracket that will leave no screw or nail marks, holes or any permanent scarring to the wood window frame.

Another object of the present invention is to provide a curtain mounting bracket that can be installed in less than one minute without the use of any tools.

Another object of the present invention is to provide a curtain mounting bracket that can hold in excess of five (5) pounds of weight.

Another object of the present invention is to provide a curtain mounting bracket that is made of light-weight stamped metals or durable and rigid moldable plastics.

Another object of the present invention is to provide a curtain mounting bracket that can be used with a pair of standard flat curtain rods or with one or more standard cylindrical curtain rod.

A further object of the present invention is to provide a curtain mounting bracket that can be mass produced in an automated and economical manner and is readily affordable by the consumer.

SUMMARY OF THE INVENTION

In accordance with the present invention, there is provided curtain mounting brackets for curtain rods for use with conventional blind bracket mounting devices of a blind assembly for attaching one or more curtain rods thereon in order to hold a curtain and/or valance thereto. The curtain mounting brackets include a first bracket housing having a first holding wall member with an upper first perimeter edge with an upper first L-shaped retaining tab member thereon, a lower first perimeter edge with a lower first L-shaped retaining tab member thereon, a first side perimeter edge and a second perimeter edge; the first holding wall member includes an integrally connected first curtain rod holding element thereon; and the upper first L-shaped retaining tab member of the first holding wall member for engaging and being joined to an upper receiving channel of the conventional blind bracket mounting device, and the lower L-shaped retaining tab member of the first holding wall member for engaging and being joined to a lower receiving channel of the conventional blind bracket mounting device for preventing one end of the blind assembly from falling out of the blind bracket mounting device. The curtain mounting brackets also include a second bracket housing having a second holding wall member with an upper second perimeter edge with an upper second L-shaped retaining tab member thereon, a lower second perimeter edge with an upper second L-shaped retaining tab member thereon, al lower second perimeter edge with a lower second L-shaped retaining tab member thereon, a third side perimeter edge and a fourth side perimeter edge; the second holding wall member includes an integrally connected second curtain rod holding element thereon; and the upper second L-shaped retaining tab member of the second holding wall member for engaging and being joined to an upper receiving channel of the conventional blind bracket mounting device, and the lower second L-shaped retaining tab member of the second holding wall member for engaging and being joined to a lower receiving channel of the conventional blind bracket mounting device for preventing the other end of the blind assembly from falling out of the blind bracket mounting device. The first and second curtain rod holding elements of the first and second holding wall members are used for receiving one or more curtain rods thereon.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein:

FIG. 3 is an exploded front perspective view of the curtain mounting bracket of the first embodiment of the present invention showing the mounting brackets being connected within the bracket mounting devices, and the flat curtain rods being attached to the holding prong members;

FIG. 4 is a side elevational view of the curtain mounting bracket of the present invention showing a holding prong member and the holding wall member;

FIG. 5 is a top plan view of the curtain mounting bracket of the present invention showing the holding prong members and the holding wall member;

DETAILED DESCRIPTION OF THE EMBODIMENTS OVERVIEW

Figure 1:
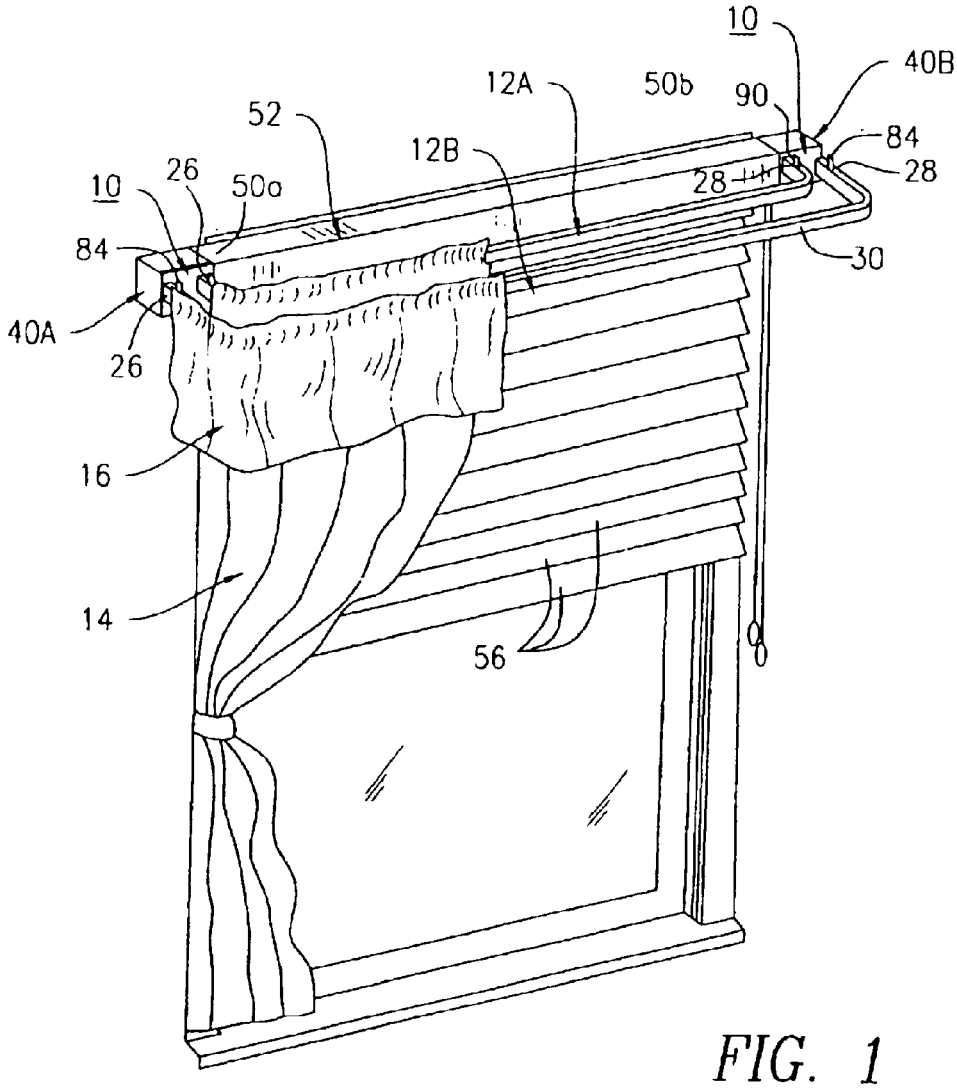
FIG. 1 is a perspective view of the curtain mounting brackets of the first embodiment of the present invention showing the mounting brackets in an assembled state and in operational use.

The curtain mounting brackets 10, 100 and 200 of the first, second and third embodiments of the present invention are represented in detail by FIGS. 1 through 15 of the patent drawings. The curtain mounting bracket 10 of the first embodiment is used in conjunction with a pair of blind bracket mounting devices 40A and 40B being substantially rectangular in shape. The first embodiment 10 is particularly used for attaching one or more standard flat curtain rods 12A and/or 12B in order to hold a curtain 14 and a valance 16, respectively, thereon. Each flat curtain rod 12A or 12B includes a pair of holding arms 22 and 24 and a holding section 30. Each holding arm 22 and 24 includes an opening 26 and 28, respectively, therein for receiving the upper prong tab members 84 and 90 of each holding prong member 80 and 86, as depicted in FIGS. 1 and 3 of the drawings.

Figure 8:
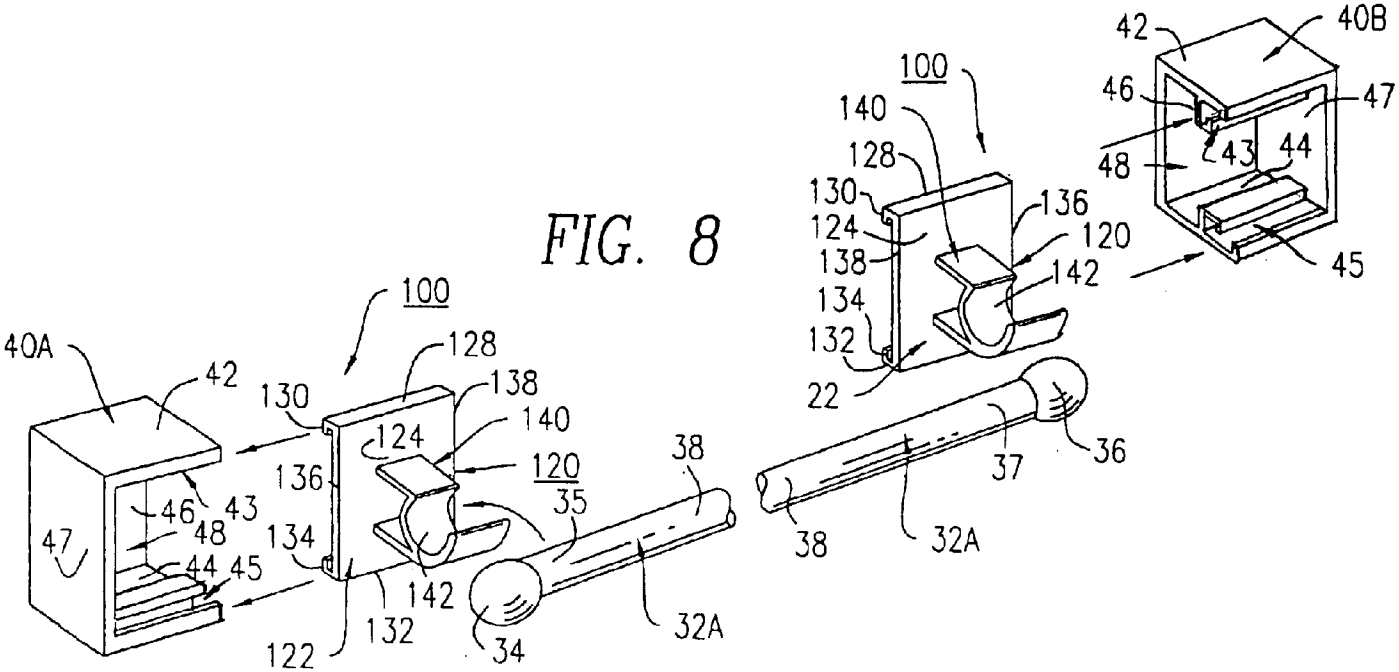
FIG. 8 is an exploded front perspective view of the curtain mounting brackets of the second embodiment of the present invention showing the mounting brackets being connected within the blind bracket mounting devices, and the cylindrical curtain rod being attached to the holding arms.
Figure 13:
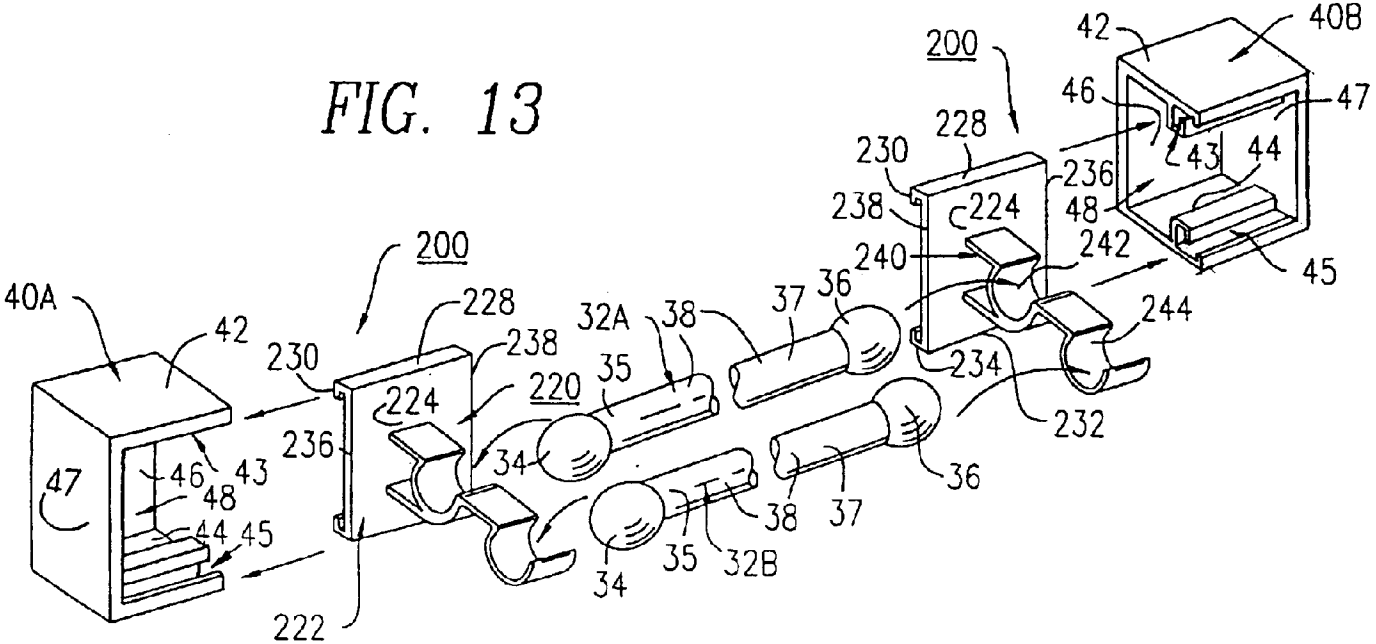
FIG. 13 is an exploded front perspective view of the curtain mounting bracket of the third embodiment of the present invention showing the mounting brackets being connected within the blind bracket mounting devices, and the cylindrical curtain rods being attached to the holding arms.

The curtain mounting brackets 100 and 200 of the second and third embodiments are used in conjunction with a pair of blind bracket mounting devices 40A and 40B being substantially rectangular in shape. The second embodiment 100 is used for a standard (single) cylindrical curtain rod 32A for holding a curtain 14 thereon, and the third embodiment 200 is particularly used for attaching one or more standard cylindrical curtain rods 32A and/or 32B in order to hold a curtain 14 and/or a valance 16, respectively, thereon. Each cylindrical curtain rod 32A or 32B includes a holding knob 34 and 36 having at each end an end holding section 35 and 37, respectively, and a center holding section 38. Each end holding section 35 and 37 is, respectively, received within the holding arm members 140 or 240, as depicted in FIGS. 6, 8, 11 and 13 of the drawings. The second and third embodiments 100 and 200 are similar in structure except for the holding arm members 140 and 240 being structurally different in configuration. Holding arm member 140 includes a single rod holding section 142 in which to hold a single cylindrical curtain rod 32A thereon, as shown in FIG. 8. Holding arm member 240 includes first (inner) and second (outer) rod holding sections 242 and 244 thereon for holding a pair cylindrical curtain rods 32A and 32B thereto, as shown in FIG. 13 of the drawings.

Figure 6:
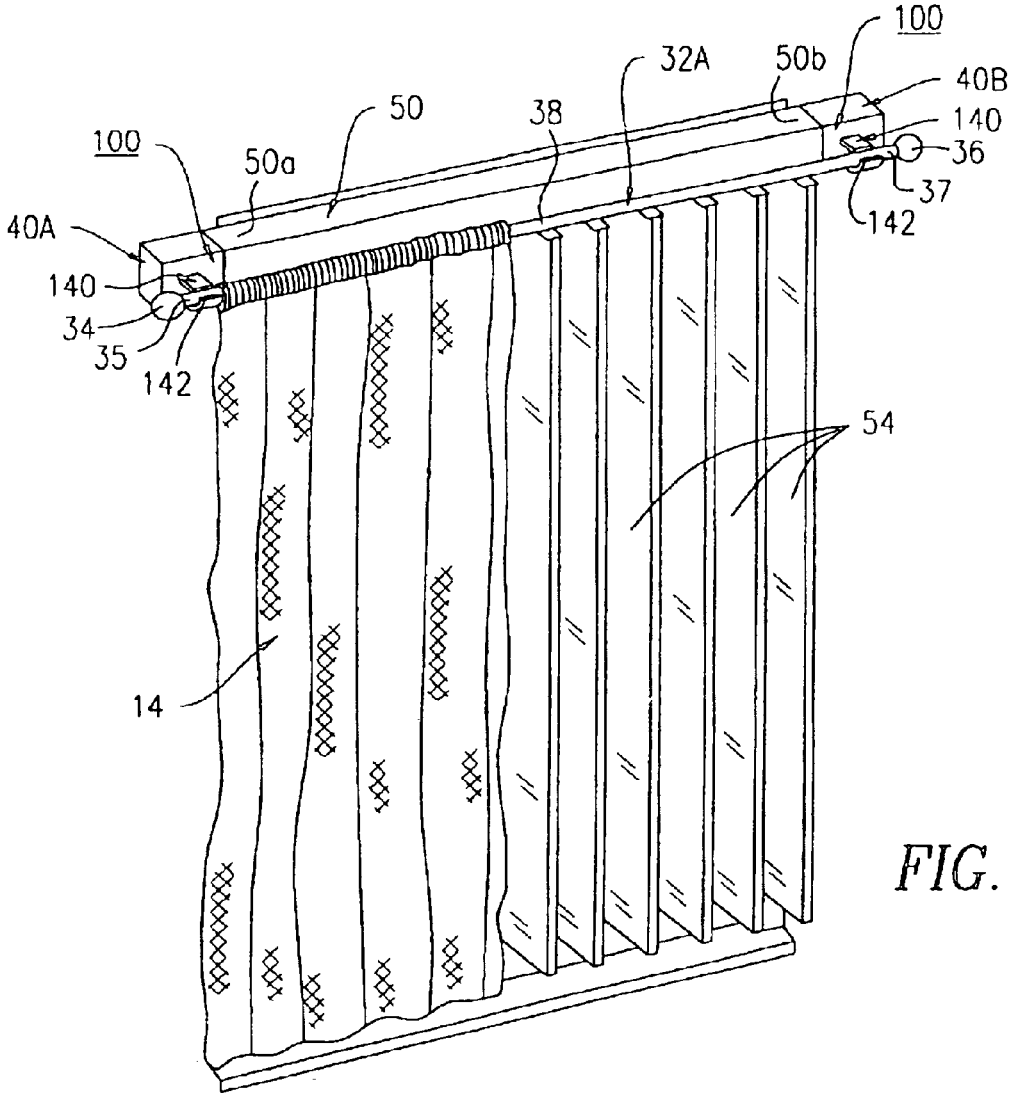
FIG. 6 is a perspective view of the curtain mounting brackets of the second embodiment of the present invention showing the mounting brackets in an assembled state and in operational use.
Figure 11:
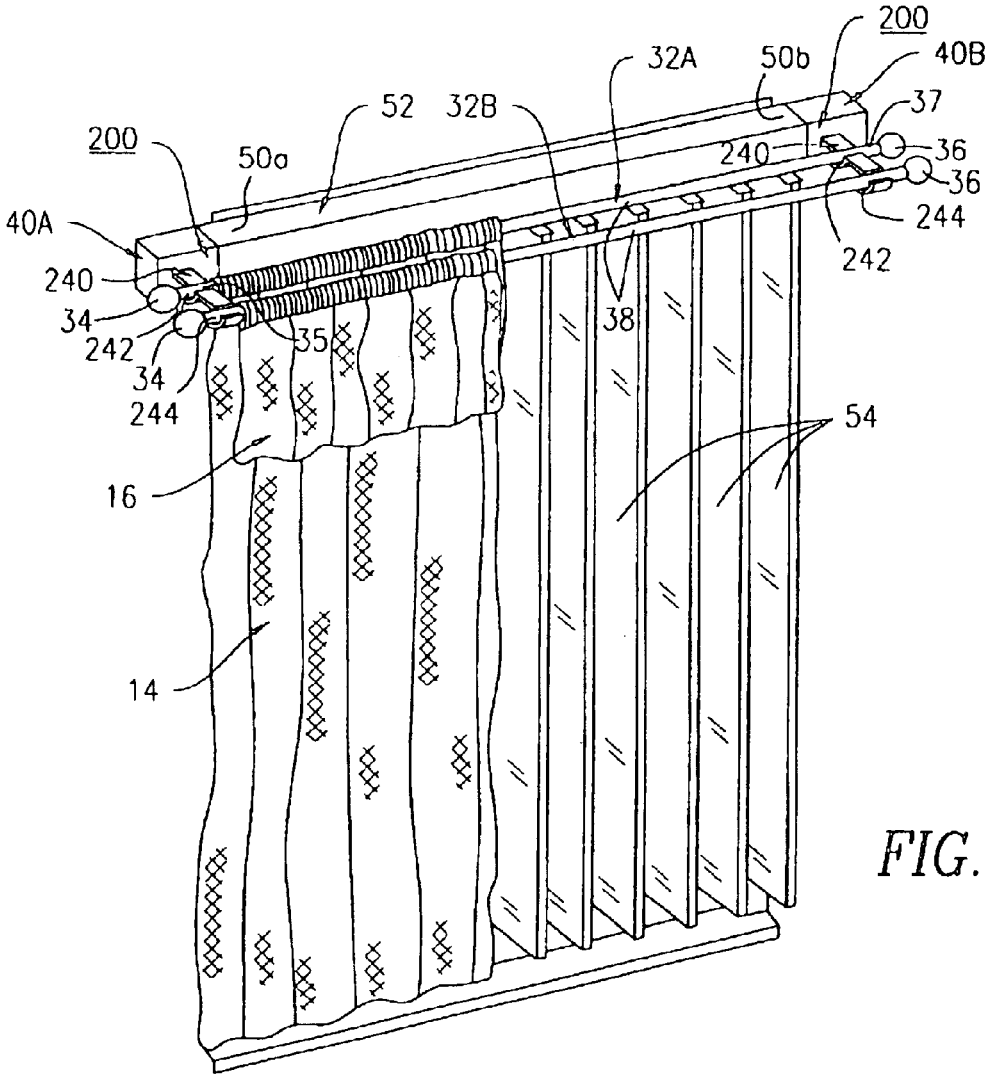
FIG. 11 is a perspective view of the curtain mounting brackets of the third embodiment of the present invention showing the mounting brackets in an assembled state and in operational use.

Each of the blind bracket mounting devices 40A and 40B includes a top wall 42, a bottom wall 44, a rear wall 46 and a side wall 47 for forming an interior compartment 48 in order to receive the outer ends 50*a* and 50*b* of the blind mounting assembly 52 for holding a plurality of the vertical blind members 54 or for holding a plurality of the horizontal blind members 56, as shown in FIGS. 1, 6 and 11 of the drawings. Top wall 42 includes an upper retaining channel 43 for receiving the L-shaped retaining tab member 74 of the upper perimeter edge 72 of holding wall member 62. Bottom wall 44 also includes a lower retaining channel 45 for receiving the L-shaped retaining tab member 78 of the lower perimeter edge 76 of holding wall member 62.

It should be understood that L-shaped retaining tab members 74 and 78 may have other shapes, such as U-shaped, or just a vertical wall member 62 having upper and lower edges 72, 76 (referred to as retaining tab members) for sliding in or being received within channels 43 and 45.

The curtain mounting brackets 10, 100 or 200 can be made from durable and rigid molded plastics or light-weight stamped metals. The curtain mounting brackets 10, 100 or 200 become an integral component of the blind apparatus 52 and prevents the plurality of blinds 54 or 56 from falling out.

The holding wall member 62, 122 and 222 of bracket housing 60, 120 and 220 has a height dimension of 1¼ inches, a width dimension of ⅞ of an inch, and a wall thickness dimension in the range of 1/32 to 1/16 of an inch. The holding prong members 80 and 86 of the holding wall member 62 has a height dimension of ¾ of an inch, a width dimension of ⅜ of an inch, and a wall thickness dimension in the range of 1/32 to 1/16 of an inch. The holding arm member 140 has a width dimension of ⅜ of an inch and a length dimension of 1½ inches. The holding arm member 240 has a width dimension of ⅜ of an inch and a length dimension of 2½ inches. Each of the rod holding sections 142, 242 or 244 are semicircular in shape and has a diameter in the range of 7/16 to ½ of an inch.

First Embodiment 10

The curtain mounting bracket 10 and its component parts of the first embodiment of the present invention are represented in detail by FIGS. 1 through 5 of the patent drawings. The curtain mounting brackets 10 are used for attaching one or more standard flat curtain rods 12A and/or 12B in conjunction with a pair of blind bracket mounting devices 40A and 40B of a blind mounting assembly 52 having a plurality of horizontal blind members 56 thereon, such that the flat curtain rods 12A and 12B are used to hold a curtain 14 and a valance 16 thereon, as depicted in FIG. 1 of the drawings.

Figure 2:
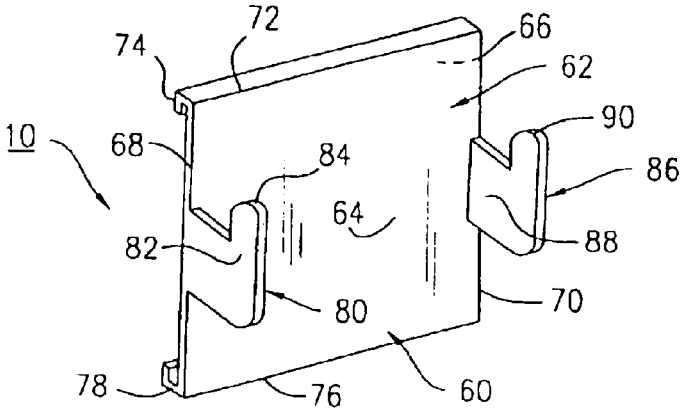
FIG. 2 is a front perspective view of the curtain mounting bracket of the first embodiment of the present invention showing the holding prong members attached to the holding wall member.

Each curtain mounting bracket 10 includes a bracket housing 60 having a holding wall member 62 and integrally connected outer and inner holding prong member 80 and 86 thereon, as depicted in FIGS. 2 and 3 of the drawings. Holding wall member 62 includes a front wall surface 64, a rear wall surface 66, left and right side perimeter edges 68 and 70, an upper perimeter edge 72 having an upper L-shaped retaining tab member 74 thereon, and a lower perimeter edge 76 having a lower L-shape retaining tab member 78 thereon. First side perimeter edge 68 includes an integrally connected outer holding prong member 80 having a prong holding side wall 82 with an upper prong tab member 84 thereon. Second side perimeter edge 70 includes an integrally connected inner holding prong member 86 having a prong holding side wall 88 with an upper prong tab member 90 thereon. The upper prong tab members 84 and 90 are received with tab receiving openings 26 and 28 of each holding arm 22 and 24, respectively, of the standard flat curtain rods 12A and 12B, as shown in FIGS. 1 and 3 of the drawings.

Second Embodiment 100

The curtain mounting bracket 100 and its component parts of the second embodiment of the present invention are represented in detail by FIGS. 6 through 10 of the patent drawings. The curtain mounting brackets 100 are used for attaching a single standard cylindrical curtain rod 32*a* in conjunction with a pair of blind bracket mounting devices 40A and 40B of a blind mounting assembly 50 having a plurality of vertical blind members 54 thereon, such that the single cylindrical curtain rod 32A is used to hold a curtain 14 or a valance 16 thereon, as depicted in FIG. 6 of the drawings.

Figure 7:
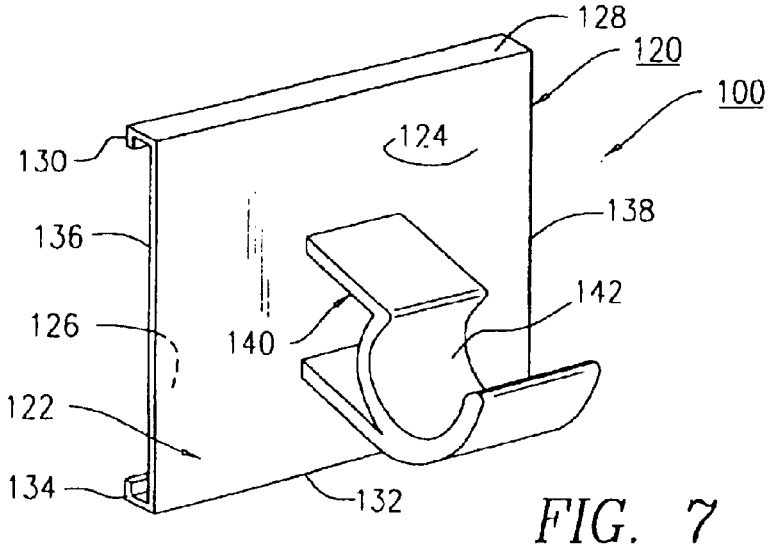
FIG. 7 is a front perspective view of the curtain mounting bracket of the second embodiment of the present invention showing the bracket element having a holding arm thereon.
Figure 9:
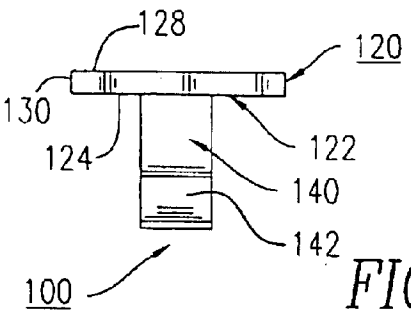
FIG. 9 is a side elevational view of the curtain mounting bracket of the present invention showing the holding arm and the bracket element wall.
Figure 10:
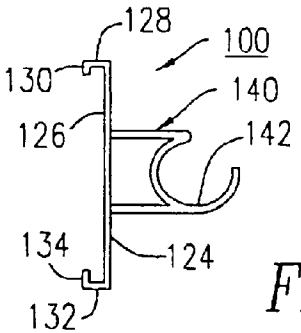
FIG. 10 is a top plan view of the curtain mounting bracket of the present invention showing the holding arm and the bracket element wall.

Each curtain mounting bracket 100 includes a bracket housing 120 having a holding wall member 122 and an integrally attached holding arm member 140 with a rod holding section 142 thereon, as depicted in FIGS. 7 and 8 of the drawings. Holding wall member 122 includes a front wall surface 124, a rear wall surface 126, an upper perimeter edge 128 having an upper L-shaped retaining tab member 130 thereon, a lower perimeter edge 132 having a lower L-shaped retaining tab member 134 thereon, and side perimeter edges 136 and 138, as shown in FIGS. 7, 9 and 10 of the drawings. Front wall surface 124 includes an integrally attached holding arm member 140 having a single rod holding section 142 thereon. The holding arm member 140 is centrally located on the front wall surface 124 of holding wall member 122, as depicted in FIG. 7 of the drawings. The holding arm member 140 is at a 90° degree angle with respect to the front wall surface 124 of holding wall member 122. The rod holding sections 142 are for receiving the end holding sections 35 and 37 of the single cylindrical curtain rod 32A, respectively, as shown in FIGS. 6 and 7 of the drawings.

Third Embodiment 200

The curtain mounting bracket 200 and its component parts of the third embodiment of the present invention are represented in detail by FIGS. 11 through 15 of the patent drawings. The curtain mounting brackets 200 are used for attaching one or more standard cylindrical curtain rods standard cylindrical curtain rods 32A and/or 32B in conjunction with a pair of blind bracket mounting devices 40A and 40B of blind mounting assembly 52 having a plurality of vertical blind members 54 thereon, such that the cylindrical curtain rods 32A and 32B are used to hold a curtain 14 and a valance 16 thereon, as shown in FIG. 11 of the drawings.

Figure 12:
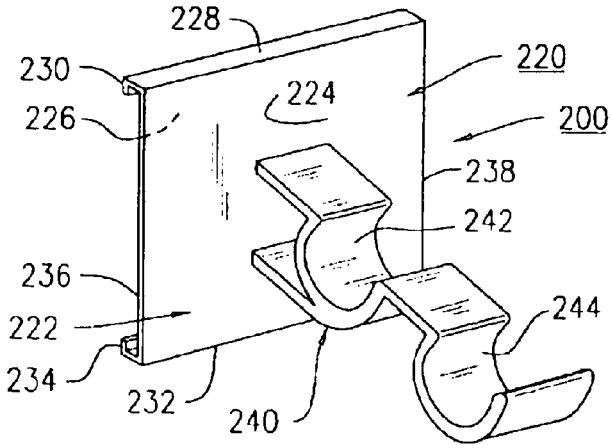
FIG. 12 is a front perspective view of the curtain mounting bracket of the third embodiment of the present invention showing the bracket element having a holding arm thereon.
Figure 15:
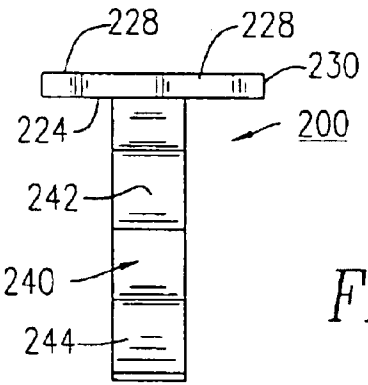
FIG. 15 is a top plan view of the curtain mounting bracket of the present invention showing the holding arm and the bracket element wall.
Figure 14:
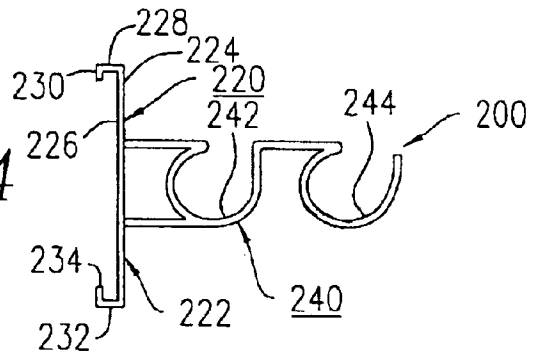
FIG. 14 is a side elevational view of the curtain mounting bracket of the present invention showing the holding arm and the bracket element wall.

Each curtain mounting bracket 200 includes a bracket housing 220 having a holding wall member 222 and an integrally attached holding arm member 240 with inner and outer rod holding sections 242 and 244 thereon, as depicted in FIGS. 12 and 13 of the drawings. Holding wall member 222 includes a front wall surface 224, a rear wall surface 226, an upper perimeter edge 228 having an upper L-shaped retaining tab member 230 thereon, a lower perimeter edge 232 having a lower L-shaped retaining tab member 234 thereon, and side perimeter edges 236 and 238, as shown in FIGS. 12, 14 and 15 of the drawings. Front wall surface 224 includes an integrally attached holding arm member 240 having a pair of inner and outer rod holding sections 242 and 244 thereon. The holding arm member 240 is centrally located on the front wall surface 224 of holding wall member 222, as depicted in FIG. 12 of the drawings. The holding arm member 240 is at a 90° degree angle with respect to the front wall surface 244 of holding wall member 222. The inner and outer rod holding sections 242 and 244 are for receiving the end holding sections 35 and 37 of the cylindrical curtain rods 32A and/or 32B, respectively, as shown in FIGS. 11 and 12 of the drawings.

Operation of the Present Invention

In operating the curtain mounting bracket 10 of the first embodiment, the user simply slides the holding wall member 62 of the bracket housing 60 inwardly, such that the upper and lower L-shaped retaining tab members 74 and 78 of the holding wall member 62 engage and form the upper and lower L-shaped retaining channels 43 and 45 of the top and bottom walls 42 and 44 of the blind bracket mounting device 40A, respectively, as shown in FIG. 3 of the drawings. The aforementioned step is repeated again for the blind bracket mounting device 40B using a second curtain mounting bracket 10, where then one or more standard flat curtain rods 12A and/or 12B can be attached to each of the two blind curtain mounting brackets 10, as depicted in FIGS. 1 and 3 of the drawings. The user now places each holding arm 22 and 24 of curtain rod 12A, via tab opening 26 and 28 onto the upper prong tab members 90 of each inner holding prong member 86, respectively, for hanging of a curtain 14 or a valance 16 thereon. If a second curtain rod 12B is needed, the user now places each holding arm 22 and 24 of curtain rod 12B, via tab openings 26 and 28 onto the upper prong tab members 84 of each outer holding prong member 80, respectively, for hanging of a valance 16 thereon, as depicted in FIG. 1 of the drawings.

In operating the curtain mounting bracket 100 of the second embodiment the user simply glides the holding wall member 122 of the bracket housing 120 inwardly, such that the upper and lower L-shaped retaining tab members 130 and 134 of the holding wall member 122 engage and join the upper and lower L-shaped retaining channels 43 and 45 of the top and bottom walls 42 and 44 of the blind bracket mounting device 40A, respectively, as shown in FIG. 8 of the drawings. The aforementioned step is repeated again for the blind bracket mounting device 40B using a second curtain mounting bracket 100, where then a single standard cylindrical curtain rod 32A can be attached to each of the two blind curtain mounting brackets 100, as depicted in FIGS. 6 and 8 of the drawings. The user now places and snaps in each of the end holding sections 35 and 37 of curtain rod 32A within each of the rod holding sections 142 of the holding arm members 140, respectively, for hanging of a curtain 14 or a valance 16 thereon, as depicted in FIG. 6 of the drawings.

In operating the curtain mounting bracket 200 of the third embodiment, the user simply slides the holding wall member 222 of the bracket housing 220 inwardly, such that the upper and lower L-shaped retaining tab members 230 and 234 of the holding wall member 222 engage and join the upper and lower L-shaped retaining channels 43 and 45 of the top and bottom walls 42 and 44 of the blind bracket mounting device 40A, respectively, as shown in FIG. 13 of the drawings. The aforementioned step is repeated again for the blind bracket mounting device 40B using a second curtain mounting bracket 200, where then one or more standard cylindrical curtain rods 32A and/or 32B can be attached to each of the two blind curtain mounting brackets 200, as depicted in FIGS. 11 and 13 of the drawings. The user now places and snaps in each of the end holding sections 35 and 37 of curtain rod 32A within each of the inner rod holding sections 242 of the holding arm members 240, respectively for hanging a curtain 14 or a valance 16 thereon, as depicted in FIG. 11 of the drawings. If a second curtain rod 32B is needed, the user now places each of the end holding sections 35 and 37 of curtain rod 32B within each of the outer rod holding sections 244 of the holding arm members 240, respectively, for hanging of a valance 16 thereon, as shown in FIG. 11. When in an assembled state each of the holding arm members 140 or 240 are in a parallel relationship with each other, as shown in FIGS. 8 and 13 of the drawings.

At no time did the user have to use any tools in placing each of the curtain mounting brackets 10, 100 or 200 within the bracket mounting devices 40A and 40B. Further, each of the curtain mounting brackets 10, 100 or 200 can hold in excess of five (5) pounds of weight including the curtain rods, curtains and valance when in an assembled state. Each of the curtain mounting brackets 10, 100 or 200 can be installed within each of the blind bracket mounting devices 40A and 40B in less than 60 seconds.

Advantages of the Present Invention

Accordingly, an advantage of the present invention is that it provides for a curtain mounting bracket for use in attaching one or more curtain rods for hanging curtains and valances in conjunction with a blind bracket mounting device of a standard blind apparatus.

Another advantage of the present invention is that it provides for a curtain mounting bracket that is an integrated component of the blind bracket mounting device and prevents the vertical or horizontal blind members from falling out.

Another advantage of the present invention is that it provides for a curtain mounting bracket that does not utilize any screws, staples or nails, nor do damage to a window border.

Another advantage of the present invention is that it provides for a curtain mounting bracket that does not require any permanent settings on the blind frame assembly, and each curtain mounting bracket is slidably mounted within each blind bracket mounting device.

Another advantage of the present invention is that it provides for a curtain mounting bracket that will leave no screw or nail marks, holes or any permanent scarring to the wood window frame.

Another advantage of the present invention is that it provides for a curtain mounting bracket that can be installed in less than one minute without the use of any tools.

Another advantage of the present invention is that it provides for a curtain mounting bracket that can hold in excess of five (5) pounds of weight.

Another advantage of the present invention is that it provides for a curtain mounting bracket that is made of light-weight stamped metals or durable and rigid moldable plastics.

Another advantage of the present invention is that it provides for a curtain mounting bracket that can be used with a pair of standard flat curtain rods or with a standard cylindrical curtain rod.

A further advantage of the present invention is that it provides for a curtain mounting bracket that can be mass produced in an automated and economical manner and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Curtain mounting brackets for curtain rods for use with conventional blind bracket mounting devices of a blind assembly for attaching one or more curtain rods thereon in order to hold a curtain and/or valance thereto, comprising:

a) a blind mounting bracket device b) a first bracket housing including a first holding wall member having an upper channel, a lower channel, a first side perimeter edge and a second side perimeter edge;

c) said first holding wall member having mounted thereon an outer first curtain rod holding prong member and a an inner second curtain rod holding prong member;

d) said upper channel engaging and being joined to an upper receiving channel of the conventional blind bracket mounting device, and said lower channel engaging and being joined to a lower receiving channel of the conventional blind bracket mounting device in order to interlock said upper and lower channels of said first bracket within said upper and lower receiving channels of the conventional blind bracket mounting device for preventing one end of the blind assembly from falling out of the blind bracket mounting device;

e) a second bracket housing including a second holding wall member having an upper channel, a lower channel, a third side perimeter edge and a fourth side perimeter edge;

f) said second holding wall member having mounted thereon an outer third curtain rod holding prong member and an inner fourth curtain rod holding prong member;

g) said upper channel for engaging and being joined to an upper receiving channel of the conventional blind bracket mounting device, and said lower channel for engaging and being joined to a lower receiving channel of the conventional blind bracket mounting device in order to interlock said upper and lower channels of said second bracket within said upper and lower receiving channels of the conventional blind bracket mounting device for preventing the other end of the blind assembly from falling out of the blind bracket mounting device;

h) said curtain rod holding prong members are for receiving one or more curtain rods thereon; and i) said interlocking of said upper and lower channels of said first and second brackets within each of the upper and lower receiving channels of the conventional blind bracket mounting devices, respectively, such that one or more curtain rods attached to said first and second brackets can hold in excess of five (5) pounds of weight of valances, curtains or drapes when in an assembled state and in operational use thereof.

2. Curtain mounting brackets in accordance with claim 1, wherein each of said upper and lower channels of each of said first and second holding wall members is U-shaped for slidably receiving each of said upper and lower receiving channels, respectively.

3. Curtain mounting brackets in accordance with claim 1, wherein said outer first curtain rod holding prong member includes a first side wall having an upper first prong tab member thereon, and said inner second curtain rod holding prong member includes a second side wall having an upper second prong tab member thereon.

4. Curtain mounting brackets in accordance with claim 3, wherein said outer third curtain rod holding prong member includes a third side wall having an upper third prong tab member thereon, and said inner fourth holding prong member includes a fourth side wall having an upper fourth curtain rod prong tab member thereon.

5. Curtain mounting brackets in accordance with claim 4, wherein said upper second and fourth prong tab members of said inner second and fourth holding prong members are used to receive an inner first flat curtain rod thereon, and said upper first and third prong tab members of said outer first and third holding prong members are used to receive an outer second flat curtain rod thereon.

6. Curtain mounting brackets in accordance with claim 1, wherein each of said upper and lower receiving channels of each of the blind bracket mounting devices has a locking lip for preventing each of said first and second holding wall members from falling out of the blind bracket mounting devices.

7. Curtain mounting brackets in accordance with claim 1, wherein said outer first and third holding prong members are centrally positioned on said first and third side perimeter edges of said first and second holding wall members, respectively.

8. Curtain mounting brackets in accordance with claim 1, wherein said inner second and fourth holding prong members are centrally positioned on said second and fourth side perimeter edges of said first and second holding wall members, respectively.

9. Curtain mounting brackets in accordance with claim 1, wherein said outer first and inner second holding prong members on said first holding wall member are in a parallel relationship with each other.

10. Curtain mounting brackets in accordance with claim 1, wherein said outer third and inner fourth holding prong members on said second holding wall member are in a parallel relationship with each other.

11. Curtain mounting brackets in accordance with claim 1, wherein said first holding wall member includes a first holding arm member having a first set of one or more rod holding sections therein, said first set of one or more rod holding sections of said first holding arm member for holding in place one end of a cylindrical curtain rod.

12. Curtain mounting brackets in accordance with claim 11, wherein said first holding arm member is centrally located on said first holding wall member.

13. Curtain mounting bracket in accordance with claim 11, wherein said second holding wall member includes a second holding arm member having a second set of one or more rod holding sections therein, said second set of one or more rod holding sections of said second holding arm member for holding in place the other end of a cylindrical curtain rod.

14. Curtain mounting brackets in accordance with claim 13, wherein said second holding arm member is centrally located on said second holding wall member.

15. Curtain mounting brackets in accordance with claim 13, wherein said first and second holding arm members are used for holding in place the end sections of one or more cylindrical curtain rods in a parallel relationship with each other.

16. Curtain mounting brackets in accordance with claim 13, wherein said first and second holding arm members on said first and second holding wall members are in a parallel relationship with each other.

17. Curtain mounting brackets in accordance with claim 13, wherein said first and second holding arm members are at a 90° degree angle with respect to said first and second holding wall members, respectively.

18. Curtain mounting brackets in accordance with claim 13, wherein said first and second holding arm members include two or more rod holding sections for holding two or more cylindrical curtain rods thereon.

19. Curtain mounting brackets in accordance with claim 1, wherein said brackets can be made from durable, rigid moldable plastics from light-weight stamped metals.

20. Curtain mounting brackets for curtain rods for use with conventional blind bracket mounting devices of a blind assembly for attaching one or more cylindrical curtain rods thereon in order to hold a curtain and/or valance thereto, comprising:

a blind bracket mounting device b) a first bracket housing including a first holding wall member having an upper channel, and a lower channel;

c) said first holding wall member having a first holding arm member mounted thereon with a first set of one or more rod holding sections therein, said first set of one or more rod holding sections of said first holding arm member for holding in place one end of the cylindrical curtain rod;

d) said upper channel of said first holding wall member engaging and being joined to an upper receiving channel of the conventional blind bracket mounting device, and said lower channel of said first holding wall member engaging and being joined to a lower receiving channel of the conventional blind bracket mounting device in order to interlock said upper and lower channels of said first bracket within said upper and lower receiving channels of the conventional blind bracket mounting device for preventing one end of the blind assembly from falling out of the blind bracket mounting devices;

e) a second bracket housing including a second holding wall member having an upper channel, and a lower channel;

f) said second holding wall member having a second holding arm member mounted thereon with a second set of one or more rod holding sections therein, said second set of one or more rod holding sections of said second holding arm member for holding in place the other end of the cylindrical curtain rod;

g) said upper channel of said second holding wall member for engaging and being joined to an upper receiving channel of the conventional blind bracket mounting device, and said lower channel of said second holding wall member for engaging and being joined to a lower receiving channel of the conventional blind bracket mounting device in order to interlock said upper and lower channels of said second bracket within said upper and lower receiving channels of the conventional blind bracket mounting device for preventing the other end of the blind assembly from falling out of the blind bracket mounting device;

h) said first and second holding arm members for holding in place the ends of one or more cylindrical curtain rods in a parallel relationship with each other; and i) said interlocking of said upper and lower channels of said first and second brackets within each of the upper and lower receiving channels of the conventional blind bracket mounting devices, respectively, such that one or more curtain rods attached to said first and second brackets can hold in excess of five (5) pounds of weight of valances, curtains or drapes when in an assembled state and in operational use thereof.

21. Curtain mounting brackets in accordance with claim 20, wherein said first and second holding arm members on said first and second holding wall members are in a parallel relationship with each other.

22. Curtain mounting brackets in accordance with claim 20, wherein said first and second holding arm members are at a 90° angle with respect to said first and second holding wall members, respectively.

23. Curtain mounting brackets in accordance with claim 20, wherein said holding arm members include two or more rod holding sections for holding two or more cylindrical curtain rods.

24. Curtain mounting brackets in accordance with claim 20, wherein said brackets can be made from durable, rigid moldable plastics or from light-weight stamped metals.

25. Curtain mounting brackets in accordance with claim 20, wherein said holding wall members have a height dimension of 1¼ inches, a width dimension of ⅞ of an inch and a wall thickness in the range of 1/32 to 1/16 of an inch.

26. Curtain mounting brackets in accordance with claim 20, wherein each of said holding arm members have a length dimension of 1½ inches and a width dimension of ⅜ of an inch.

27. Curtain mounting brackets in accordance with claim 20, wherein each of said holding arm members have a length dimension of 2½ inches and a width dimension of ⅜ of an inch.

28. Curtain mounting brackets in accordance with claim 20, wherein each of said rod holding sections are semi-circular in shape and has a diameter in the range of 7/16 to ½ of an inch.

29. Curtain mounting bracket in accordance with claim 20, wherein said first holding arm member on said first holding wall member is centrally located and integrally attached to said first holding wall member.

30. Curtain mounting bracket in accordance with claim 20, wherein said second holding arm member on said second holding wall member is centrally located and integrally attached to said second holding wall member.

* * * * *